US005484453A

United States Patent [19]

Baehr et al.

[11] Patent Number: 5,484,453

[45] Date of Patent: Jan. 16, 1996

[54] COMPOSITION AND PROCESS FOR TREATING TEXTILE MATERIALS

[75] Inventors: Bernd-Dieter Baehr, Neuss; Hildegard von Delden, Hilden; Wolfgang Lillotte, Moenchengladbach, all of Germany

[73] Assignee: Henkel Kommanditgesellschaft auf Aktien, Duesseldorf, Germany

[21] Appl. No.: 140,118

[22] PCT Filed: Apr. 23, 1992

[86] PCT No.: PCT/EP92/00904

§ 371 Date: Nov. 2, 1993

§ 102(e) Date: Nov. 2, 1993

[87] PCT Pub. No.: WO92/19806

PCT Pub. Date: Nov. 12, 1992

[30] Foreign Application Priority Data

| | | | |
|---|---|---|---|
| May 2, 1991 | [DE] | Germany | 41 14 241.1 |
| Jan. 31, 1992 | [JP] | Japan | 42 02 720.9 |

[51] Int. Cl.[6] ..... D06M 23/06; D06L 3/02

[52] U.S. Cl. ..... 8/111; 8/127.1

[58] Field of Search ..... 8/111, 127.1

[56] References Cited

U.S. PATENT DOCUMENTS

| | | | |
|---|---|---|---|
| 2,794,004 | 5/1957 | Ratti | 252/353 |
| 3,449,261 | 6/1969 | Ross, Jr. et al. | 252/351 |
| 4,074,634 | 6/1978 | Becker et al. | 8/127.1 |
| 4,258,448 | 3/1981 | Reitz et al. | 8/282 |
| 4,579,559 | 4/1986 | Canela | 8/127.1 |
| 4,740,210 | 4/1988 | Amati et al. | 8/94.23 |
| 4,844,710 | 7/1989 | Guth et al. | 8/127.1 |
| 4,996,854 | 3/1991 | Heidan et al. | 68/5 D |

FOREIGN PATENT DOCUMENTS

| | | |
|---|---|---|
| 0268816 | 3/1988 | European Pat. Off. . |
| 0352591 | 1/1990 | European Pat. Off. . |
| 1102064 | 10/1955 | France . |
| 3430832 | 3/1985 | Germany . |
| 0545681 | 7/1985 | Spain . |

OTHER PUBLICATIONS

"textil praxis international", Textil Hilfsmittel Katalog in Tabellenform, Ausgave 1991, Konradin Verlag Robert Kohlhammer GmbH, D Leinfelden–Echterdingen, Unterkapital 3.3 Fäbereinetzmittel (wetting agents for dyeing), Entüftungsmittel (deaerating agents), loc. cit., pp. 73 to 77.

W. Kothe et al., "Foaming Problems in the Finishing of Textiles)", Textil–Veredelung 14 (1979), 274 to 279 (no month available).

Textil–Veredelung, K. Reincke, "Foam–Free Wetting in Dyeing Apparatus and Machines", Textilpraxis 1973, p. 461 (no month available).

Winnacker/Küchler in "Chemische Technologie", vol. 7, pp. 120 to 123, Carl–Hanser–Verlag, MÜchen/Wien 1986 (no month available).

Winnacker/Küchler: "Chemische Technologie", vol. 17, pp. 131 to 132, Carl–Hanser–Verlag, München/Wien 1986 (no month available).

*Primary Examiner*—Ellen M. McAvoy
*Assistant Examiner*—James M. Silbermann
*Attorney, Agent, or Firm*—Ernest G. Szoke; Wayne C. Jaeschke; Real J. Grandmaison

[57] ABSTRACT

The invention relates to improvements in the spraying of water-based treatment liquors onto textile materials, more particularly in the continuous treatment of web-form textile materials, the treatment liquors being sprayed in particular under the conditions of aerosol/superheated steam application. The invention is characterized in that the water-based treatment liquors used contain deaerating components free or at least substantially free from foam under the spraying conditions in dissolved, homogeneously emulsified and/or homogeneously dispersed form in such high concentrations that the textile material is thoroughly wetted almost immediately. The invention also relates to processes for simultaneously carrying out a plurality of treatment stages in a single step and to preparations suitable for these processes, for example preparations and a process for simultaneously desizing, scouring and bleaching cellulose-containing textile materials.

18 Claims, No Drawings

COMPOSITION AND PROCESS FOR TREATING TEXTILE MATERIALS

BACKGROUND OF THE INVENTION

1. Field of the Invention

Even in the most simple cases, the industrial manufacture of textiles, normally by treatment of a web-form material by the so-called continuous process, involves a plurality of successive treatment stages in which the web-form textile material is exposed to the action of generally water-based treatment liquors. The nature of the textile material used, the degree of finishing achieved in preliminary stages, if any, and the ultimate objective determine the choice of the chemicals or mixtures of chemicals suitable for the particular treatment stage and also the working conditions under which they develop their effect and/or react off on the textile material.

2. Discussion of Related Art

The teaching according to the present invention is based on the continuing need in practice to achieve considerable reductions in working time and in the number of treatment stages absolutely necessary and, optionally, to combine a plurality of treatment steps hitherto carried out separately into a single treatment step. Recent developments in machinery of the type used in the field in question, as described in ES-A1-545 681 and in EP-A1-0 352 591, have opened up new possibilities in this regard in relation to conventional textile finishing. Both documents describe new methods of spraying water-based treatment liquors onto web-form textile material, the last document in particular dealing at length with the techological problems involved in the application of liquors by aerosol/superheated steam spraying. Design measures are proposed for overcoming the various difficulties of this technology.

The teaching according to the present invention, which is described in detail hereinafter, is based on existing knowledge of modern continuous processes. The invention seeks to enable these technical possibilities to be broadly applied in improved form. Accordingly, the invention also seeks inter alia to enable a plurality of process steps hitherto carried out in succession to be combined into a single treatment step. Even without this further development, however, the invention seeks to enable each of the various treatment steps involved in the continuous process to be rationalized and, in particular, to be shortened in duration.

The crux of the solution proposed by the invention lies in the combination of a specifically selected process for applying the treatment liquor onto or into the textile material and the specific influencing of the behavior of the treatment liquor on and in the textile material during and after its application under the working conditions. Through a controlled chemical modification of the treatment liquor, the teaching of the invention seeks to ensure that individual, separate process steps can be reliably carried out in very short times and/or that a plurality of successive process steps can be combined with one another into a multifunctional treatment step, more particularly of shortened duration. Above all, however, the invention also seeks in this regard to ensure that the textile web as a whole is uniformly finished throughout in the required manner, despite the drastically shortened duration of the treatment.

DESCRIPTION OF THE INVENTION

In a first embodiment, therefore, the present invention relates to a process for spraying water-based treatment liquors onto textile materials, more particularly in the continuous treatment of web-form textile materials, characterized in that the water-based treatment liquors used contain deaerating components which are foam-free or at least substantially foam-free under the spraying conditions in dissolved, homogeneously emulsified and/or homogeneously dispersed form and in such high concentrations that the textile material is thoroughly wetted almost immediately.

More particularly, the teaching according to the invention seeks to enable the water-based treatment liquors to be sprayed as hot liquors, preferably in the form of an aerosol/superheated steam system so that kinetic and thermal energy are simultaneously introduced into the web-form textile material.

The concentrations of the deaerating components in the treatment liquor are preferably selected in such a way that complete wetting of the textile material, including the displacement of even microdisperse residual air from the internal structure of the textile material, is obtained over a period of at most a few minutes under the working conditions. The preferred duration of this complete deaeration, including the displacement of microdisperse residual air, is at most about 5 minutes and is preferably not more than about 1 minute. In important embodiments, the desired result of complete deaeration of the web-form textile material is required almost immediately and, at the same time, together with application of the liquor and, in practice, is also achieved as such.

In another embodiment, the invention relates to the use of the process described above for shortening the duration of individual treatment stages or even for combining several treatment stages in the continuous treatment of gray textile materials and/or in the finishing of textile materials. In one particularly important embodiment, the teaching of the invention seeks to combine essential treatment stages from the pretreatment technology of cellulose-containing textile materials, more particularly based on cotton, optionally blended with other fibers of natural and/or synthetic origin. In this embodiment, the invention relates in particular to a process for simultaneously desizing, scouring and bleaching cellulose-containing textile materials and to the preparations used for this purpose.

The machine-based possibilities afforded, for example, by the teaching of EP-A1 0 352 591 for the continuous treatment of textile materials and the resulting reductions in the duration of individual treatment steps or a plurality of treatment steps are limited by the following precondition: there must be a reliable guarantee that the particular treatment effects required are obtained absolutely uniformly (edge-middle-edge, beginning-end). High production safety, reproducibility and flexibility in regard to the range of articles must be guaranteed. Difficult working conditions are often created in this regard by the presence of a plurality of foreign substances on the textile material which make it difficult for the liquor to reach the textile fibers, are generally undesirable and have to be eliminated.

The following complicating general rule applies to all textile materials and to their treatment with water-based liquors. In the wetting of a dry textile material with water-based liquors, considerable amounts of static residual air are retained in the textile, even in cases where wetting auxiliaries in the form of conventional surfactants are used to reduce the surface tension of the water and hence to increase the difference in surface tension between the surface of the fibers and the water. More particularly, the finely disperse air trapped in the fibers (microdisperse residual air) can only be removed with considerable additional effort. However, the removal of this residual air is absolutely essential if the treatment preparations introduced via the water-based liquor are to reach the entire surface of the fiber structure and, hence, are to be able to develop the desired effect.

In conventional processes for the treatment, washing and cleaning of textiles, the difficulties outlined in the foregoing are overcome by applying a combination of chemicals and mechanical and/or thermal energy.

Even in known multistage continuous processes, the textile material is exposed to a considerable degree to the action of additional mechanical energy. With the shortening of the treatment time, for example in accordance with the teaching of the EP-A1 cited above, substantial proportions of this input of mechanical energy into the textile web during the treatment process itself are eliminated simply by the reduction in its duration. The input of mechanical energy is even further reduced where a plurality of treatment steps are combined into a single step of short duration.

The teaching according to the invention is based on the realization that errors and/or irregularities in the desired result can be safely avoided by the suitable choice and use of so-called deaerating components in the water-based treatment liquors under the particular working conditions discussed herein for spray application of the treatment liquor and the shortened treatment in the continuous process. To the expert on the manufacture and processing of textiles, so-called deaerating agents are understood to be a comparatively small class of substances which, in the context of the teaching according to the invention, are additionally distinguished by their ability rapidly to wet the surface of fibers in aqueous phase without at the same time showing a pronounced tendency towards foaming. Reference is made by way of example to the following summary of commercial products: "textil praxis international", Textil Hilfsmittel Katalog in Tabellenform, Ausgabe 1991, Konradin Verlag Robert Kohlhammer GmbH, D Leinfelden-Echterdingen, Unterkapitel 3.3 Färbereinetzmittei (wetting agents for dyeing), Entlüftungsmittel (deaerating agents), loc. cit., pages 73 to 77. Information on the use of deaerating agents in the finishing of textiles and on the way in which they work can also be found, for example, in the Article by W. Kothe et al. entitled "Schaumprobleme in der Textilveredelung (Foaming Problems in the Finishing of Textiles)", TEXTIL-VEREDELUNG 14 (1979), 274 to 279, more particularly Unterkapitel 5.3 "Entlüften von Textilgut (Deaeration of Textile Material)", loc. cit. 278. This Article describes the use of a basically water-insoluble phosphoric acid trialkyl ester in a surfactant-containing water-based bath through which the textile web is passed for impregnation.

The teaching according to the invention departs from this existing knowledge and uses deaerating components in water-based treatment liquors which are applied to the textile material by spraying and, more particularly, by the method of aerosol/superheated steam spraying. For the desired chemical reaction on the surface of the fibers, the liquors generally contain additives which, for their part, are capable of more or less intensive foaming in water-based liquor and, by virtue of the method of application selected in accordance with the invention, can thus also lead to substantial foaming on and in the web-form textile material under the effect of the considerable kinetic energy applied via the aerosol state. However, one particularly preferred embodiment of the invention is characterized by the use of deaerating components which not only do not cause any foaming under the spraying conditions and, more particularly, during the of aerosol/superheated steam application to the web-form textile material, but are also capable, optionally in conjunction with other active components, for example corresponding surfactant components, of immediately destroying any foam formed and/or of suppressing foaming. It is only when these additional conditions are taken into account that the simplified and accelerated textile treatment process according to the above-cited documents ES-A1-545 681 and EP-A1-0 352 591 can be broadly applied in a reliable manner.

The expert in the field in question will be able to select suitable deaerating components and their in-use concentrations for the purposes of the invention by simple preliminary tests based on the information provided in the description of the invention. It is particularly preferred in accordance with the disclosure of the invention to use a certain class of deaerating components, namely the class of phosphoric acid trialkyl esters described in the literature, cf. in addition to the already cited literature reference TEXTIL-VEREDELUNG, the Article by K. Reincke entitled "Schaumfreies Netzen in Färbeapparaten und Maschinen (Foam-Free Wetting in Dyeing Apparatus and Machines)" in Textilpraxis 1973, 461. This Article describes the use Df phosphoric acid trialkyl esters in a admixture with emulsifiers. A dispersing emulsifier has to be used to obtain sufficiently spontaneous dispersion of the deaerating component in the water-containing liquor. However, it is expressly pointed out in the Article in question that this deaerating component is not suitable for use in liquors of high electrolyte content because the deaerating emulsion creams up in this case. Accordingly, this type of deaerator is unsuitable for padding liquors. According to the literature reference in question, the use of the commercial product "Leophen M" described therein is confined specifically to the foam-free wetting of textile fibers in dyeing apparatus and machines.

The teaching according to the invention goes beyond the prior art on the subject of suitable phosphoric acid triesters. One preferred embodiment of the invention is characterized by the use of selected phosphoric acid triesters which, through a predetermined chemical modification, have a certain self-emulsifying power sufficient for the particular application.

In this embodiment of the invention, phosphoric acid triesters of lower alkyl alcohols which may be at least partly alkoxylated are used as deaerators. Preferably, at least 50 mol-% and, more preferably, at least 75 mol-% of the lower alkyl alcohols used for ester formation may have been used in the form of their alkoxylated representatives for the production of the phosphoric acid triesters. Corresponding phosphoric acid triesters in which alkoxylated lower alcohols have been used almost exclusively as the ester-forming reactive components are particularly suitable.

The phosphoric acid triesters particularly suitable for the purposes of the invention are derived from alkoxylated linear, branched and/or cyclic $C_{1-6}$ alkyl alcohols which preferably have an average degree of alkoxylation of from about 1 to 5. Relatively low degrees of alkoxylation within this range, i.e. values of about 1 to 2, can be particularly suitable. Particularly suitable alkoxy groups are the corresponding units of ethylene oxide and/or propylene oxide, trialkoxyethyl phosphates being a particularly preferred class of deaerators for the purposes of the invention. An important representative of this class is tributoxyethyl phosphate.

It has surprisingly been found that deaerators of the type just defined embody the manifold combination of desired and essential effects on which the process according to the invention is based. Phosphoric acid triesters of alkoxylated lower alkyl alcohols form stable emulsions and, in general, are sufficiently self-emulsifiable in water-containing liquors of high electrolyte content. Despite this rather surfactant-like modification to their molecular structure, they have the required combination of properties, above all freedom from foam and the ability thoroughly and almost immediately to remove static residual air from the textile material treated with the corresponding water-containing liquors. They retain this ability under the complicated application conditions of the process according to the invention, namely spraying with a high kinetic energy input, more particularly by the aerosol/superheated steam process. The effect of these deaerators is not confined to the removal of static microdisperse residual air, instead deaerators of the type in question also actively counteract foaming on and in the sprayed web-form textile material, even when foaming components, for example in the form of washing-active surfactant components, have to be used in the mixture.

The particular concentrations in which the deaerating components are used have to be adapted to the particular working conditions and to the composition of the water-containing liquor. In general, the deaerating components, particularly those of the described phosphoric acid ester type, are typically used in the water-based treatment liquors in quantities of up to about 1 to 2% by weight and preferably in quantities of up to about 1% by weight, but should be present in quantities of at least about 0.01 to 0.02% by weight. Quantities of about 0.02 to 0.5% by weight of the deaerating components, based on water-containing liquor, are of particular significance. Basically, the general rule is that initially unsatisfactory results in regard to deaeration and/or foam inhibition can be improved by increasing the content of phosphoric acid triesters in accordance with the teaching of the invention.

In the process according to the invention, the textile material, particularly the web-form textile material, may be used in dry form or in wet form. It is preferable in this regard to limit the water content of wet starting material to values of at most about 100% by weight and, more particularly to values of no more than about 80% by weight, based on the dry weight of the textile. In accordance with another preferred embodiment of the teaching according to the invention, it can be useful to heat the wet textile material or even the dry textile material before the liquors modified in accordance with the invention are applied by spraying. Heating may take place in any known form. The use of heated textile materials for spray application of the liquor, particularly by the aerosol/superheated steam process, enables predetermined concentrations of the active components in the liquor introduced to be reliably controlled. Diluting effects attributable to condensing superheated steam on the initially still relatively cool textile material are thus reliably ruled out.

The total quantity of liquid phase introduced is determined by the particular requirements of the process. In general, an upper limit is imposed by the liquor uptake capacity of the textile material which should not be exceeded significantly, if at all. The liquor uptake capacity is in turn determined by the particular nature of the textile material and amounts, for example, to between about 100 and 300% by weight, based on the dry weight of the textile. In important cases, for example in the pretreatment of cotton or cotton-containing textile webs, the liquor uptake capacity is often of the order of 150% by weight.

The liquors are sprayed onto one or both sides of the web-form textile material and may also be repeatedly sprayed onto one or both sides thereof. The application of sufficient kinetic energy during spraying can be important. Not only is penetration of the textile web by the liquid phase promoted in this way, the important function of displacing the microdisperse residual air can be assigned to the shear force of the liquid phase in the textile web under the effect of the deaerator added in accordance with the invention.

In particularly important embodiments, an optimized combination of thermal and kinetic energy is introduced into the textile web to be treated by the fact that the already repeatedly mentioned spray application is carried out by an aerosol/superheated steam process. It has proved to be particularly successful in this regard to apply the liquor under elevated spraying pressures using multicomponent mixing nozzles with external mixing of sprayed water-based liquor and superheated steam, as described for example in EP-A1-0 352 591 with reference to suitable types of spray nozzles. In this type of process, both the spray jet of the water-based liquor and the steam jet issue from separate openings of the spray nozzle under elevated pressures, for example 2 to 4 bar excess pressure, and are mixed together before impinging on the textile web to be treated. The hot liquor ultimately impinging on the textile material in this mixed state is immediately activated by the thermal energy introduced and is thus able optimally to perform its-assigned function on the surface of the fibers, the co-use of the deaerating component(s) in accordance with the invention ensuring that the effect of the treatment liquor is uniform throughout the textile material, even in its microstructure.

The composition of the particular water-based treatment liquors used is determined by the particular function they are to perform. In the most simple embodiment, it may be desirable reliably to deaerate the textile material to a thoroughly soaked material which is then transferred in this state to a following treatment stage. A water-based solution, emulsion and/or dispersion of the deaerating component with no other active components added may be used in this case.

According to the invention, however, the described deaerating components are generally used in conjunction with other additives for the intended treatment of textiles in the liquor. These other additives may be dissolved, emulsified and/or dispersed in the water-containing liquor. One particularly important embodiment of the process according to the invention is characterized by the use of treatment liquors which, in conjunction with the deaerating components, contain mixtures of active components for the simultaneous completion of a plurality of textile finishing stages. Particulars of this will be provided in the following.

In the process according to the invention, the web-form textile material is continuously treated with the liquor containing deaerators and active substances or mixtures of active substances, preferably using the aerosol/superheated steam system, and may then be aftertreated in at least one other hot and/or cold stage. In many cases, it is useful to follow spraying of the liquor with an aftertreatment carried out in an atmosphere of saturated steam. It has been found that, through the co-use and presence of the deaerators used in accordance with the invention in the textile material charged with liquor, it is possible to obtain accelerating effects in regard to the desired finishing processes which were not known from the relevant prior art. This is illustrated by the following example:

The process technology for the so-called pretreatment of textile materials based on cotton or fiber blends containing cotton as a constituent generally comprises three stages, namely desizing, the alkali stage and the peroxide bleaching stage. In the case of cotton/polyester blends, however, the pretreatment comprises at least two steps, namely desizing and the peroxide bleaching stage. Hitherto, each of the pretreatment stages of desizing, alkali treatment and peroxide bleaching has involved the steps of application, reaction and washing. Under saturated steam conditions, the reaction times alone are 3 to 15 minutes in the alkali stage and 7 to 15 minutes in the peroxide bleaching stage.

In one important embodiment, the invention seeks not only substantially to shorten the duration of the process steps, but actually to combine these steps into a single treatment step. Even in the new process, the required objectives of such a pretreatment must be safely fulfilled. These objectives include a high degree of whiteness as a function of the following processes, adequate freedom from husks, good rewettability, an adequate degree of desizing and optimal removal of the impurities of the native cellulose.

The process according to the invention enables these three steps of desizing, scouring and bleaching to be combined into a single process step through the use of selected water-based liquors which contain the particular active components required in admixture with one another. However, putting this concept into practice is of necessity linked to the crux of the teaching according to the invention of simultaneously using in the treatment liquor the deaerating components which lead in the described manner to the almost immediate removal of static air, including the microdisperse residual air, and, on the other hand, prevent foaming during application of the treatment liquor, even under elevated spraying pressures.

Another possibility afforded by the process according to the invention should also be mentioned, namely:

In continuous processes, the concluding washing stage is still a comparatively complicated step so that it would be desirable to be able to reduce both its duration and also the quantity of washing water required. In EP-A1-0 258 816, applicants describe an improved process for the washing and cleaning of textiles which is characterized by the effect of ultrasound on the textile materials present in the wash liquor for accelerating the cleaning effect. For ultrasonication to be successfully applied in the washing of textiles, it is essential for the fiber micro-structure of the textile to be thoroughly soaked and deaerated in order to remove microdisperse residual air. The general principles involved are discussed in the above-cited EP-A1.

However, the web-form textile materials treated in accordance with the teaching of the invention have, by definition, actually reached this state of complete freedom from static residual air and, more particularly, micro-disperse residual air. Accordingly, the wet material from the treatment stage according to the invention is particularly suitable for use in a following washing stage accelerated by ultrasonication. Further substantial savings of time and costs can be made in this way.

Without any claim to .completeness, a few potential applications for the continuous treatment of web-form textile materials using deaerating components in the water-based liquor are mentioned in the following:

The pure desizing of an untreated textile material without subsequent or simultaneous bleaching using heat-stable enzymes and/or oxidative methods; the combination of oxidative desizing plus scouring using bases; the combination of desizing, scouring and bleaching; causticization at comparatively high alkali concentrations; the combination of oxidative desizing and causticization; a combination of desizing, scouring and causticization and, optionally, simultaneous bleaching; the "peeling" of polyester fibers to reduce fiber denier; mercerization (action of lye under tension); typical process steps from the field of dyeing; all process steps from the field of "pad steam treatment", for example padding (immersion/squeezing) and steam padding.

In one particularly important embodiment, the invention relates to preparations and to a process for the simultaneous desizing, scouring and bleaching of cellulose-containing textile materials.

Cotton contains natural impurities, for example pectins, waxes, fats, proteins, seed husks and mineral constituents and also impurities which are applied as foreign substances during the manufacture of the textile material, for example finishes, winding oils and sizes. These impurities have to be completely removed from the textile material in order to avoid subsequent problems during finishing. This is done by pretreatment, i.e. by desizing, scouring and subsequent bleaching of the cellulose-containing textile materials.

The pretreatment of cellulose-containing textile materials is normally carried out continuously in several successive process steps in which the textile material is passed through the particular treatment liquor and, after excess liquor has been squeezed off, the treatment preparation is allowed to act on the textile material for 7 to 15 minutes at 100° C. in a saturated steam atmosphere, after which the dispersed impurities and the treatment preparation are removed from the textile material by washing. The next stage of the process is carried out in the same way. This multistage process which comprises up to four stages, namely desizing, scouring, bleaching and causticization, is very time-consuming. In addition, only certain impurities can be removed from textile materials with each of the known treatment preparations, so that a treatment preparation of different chemical composition is required for each process stage. Accordingly, the problem addressed by the presence invention was, on the one hand, to provide preparations with which cellulose-containing textile materials could be simultaneously desized, scoured and bleached and, on the other hand, to develop a process with which it would be possible simultaneously to desize, scour and bleach cellulose-containing textile materials in a short time.

It has now been found that, providing the teaching according to the invention is observed, cellulose-containing textile materials can be simultaneously desized, scoured and bleached with preparations containing mixtures of selected anionic and nonionic surfactants in certain quantities. If these preparations are applied together with peroxide compounds to cellulose-containing textile materials under pressure in aerosol form and if the textile materials are subsequently subjected to saturated steam conditions in a steamer, the simultaneous desizing, scouring and bleaching of cellulose-containing textile materials is completed in at most 4 minutes.

In this embodiment, therefore, the present invention relates to a preparation in the form of a water-based solution or dispersion containing

| | |
|---|---|
| 5 to 20% | by weight anionic surfactants, more particularly alkali metal, alkaline earth metal and/or ammonium salts of $C_{12-18}$ alkane sulfonates and/or $C_{6-18}$ alkyl sulfates, |
| 2 to 10% | by weight nonionic surfactants, more particularly alkoxylated aliphatic $C_{8-22}$ alcohols, |

-continued

| | |
|---|---|
| 5 to 20% | by weight deaerators, |
| 1 to 10% | by weight complexing agents and |
| 0.1 to 1% | by weight magnesium salts, |

based in each case on the water-containing preparation, for the simultaneous desizing, scouring and bleaching of cellulose-containing textile materials.

A corresponding water-based preparation according to the invention preferably contains

| | |
|---|---|
| 5 to 12% | by weight anionic surfactants, |
| 2 to 8% | by weight nonionic surfactants, |
| 6 to 12% | by weight deaerators, |
| 1 to 5% | by weight complexing agents and |
| 0.2 to 0.8% | by weight magnesium salts. |

In a particularly preferred embodiment, the preparations according to the invention contain $C_{8-18}$ alkyl sulfates in the form of their alkali metal and/or ammonium salts as anionic surfactants. Alkyl sulfate salts are prepared in known manner by sulfatization of the corresponding alkyl alcohols, for example with .chlorosulfonic acid or sulfur trioxide. The resulting sulfuric acid semiesters of the alcohols are subsequently neutralized, for example with alkali metal hydroxides, such as sodium hydroxide, water-based solutions of alkaline earth metal hydroxides or ammonia (Winnacker/Küchler in "Chemische Technologie", Vol. 7, pages 120 to 123, Carl-Hanser-Verlag, München/Wien 1986). The alkyl alcohols to be used as educts may be linear and/or branched and of natural and/or synthetic origin.

Examples are hexyl, octyl, 2-ethylhexyl, decyl and/or dodecyl alcohol and also coconut oil and/or tallow fatty alcohol.

The preparations according to the invention contain alkoxylated, more particularly ethoxylated and/or propoxylated, alkyl and/or alkenyl alcohols of natural and/or synthetic origin containing 8 to 22 carbon atoms and preferably 10 to 18 carbon atoms as nonionic surfactants. The linear, branched or cyclic alkyl and/or alkenyl alcohols are alkoxylated with alkylene oxides, preferably ethylene oxide and/or propylene oxide, by known industrial processes (Winnacker/Küchler: "Chemische Technologie", Vol, 7, pages 131 to 132, Carl-Hanser-Verlag, München/Wien 1986). The average degree of alkoxylation of the alkoxylated alcohols obtained, which corresponds to the molar quantity of alkylene oxides added, is preferably between 1 and 20 and more preferably between 5 and 10. Examples of suitable alkyl and/or alkenyl alcohols are octyl, decyl, lauryl, myristyl, cetyl, stearyl, oleyl, behenyl alcohol and mixtures of these alcohols.

Preferred deaerating components are the phosphoric acid esters described above, particularly in the form of their phosphoric acid triesters which may be obtained, for example, by phosphating of alkoxylated $C_{1-8}$ alkyl alcohols with phosphorus oxychloride. $C_{1-6}$ alkyl alcohols may be linear, branched or cyclic. The degree of alkoxylation is between 1 and 5. Tributoxyethyl phosphate, for example, is a suitable phosphoric acid triester.

The preparations according to the invention preferably contain as complexing agents nitrogen-containing and/or nitrogen-free mono-, di- and polyphosphonic acids and/or alkali metal and/or ammonium salts thereof and/or OH-functional mono-, di- and/or polycarboxylic acids and/or alkali metal and/or ammonium salts thereof, for example 1-hydroxyethane diphosphonic acid (HEDP), aminotri(methylene phosphonic acid) (ATMP), ethylenediamine tetra(methylene phosphonic acid), diethylenetriamine penta(methylene phosphonic acid) and alkali metal and/or ammonium salts thereof, gluconic acid, sodium gluconate, tartaric acid and/or citric acid or even acrylic acid homopolymers and/or copolymers, nitrilotriacetic acid (NTA) and/or polyphosphates. Nitrogen-containing and/or nitrogen-free di- and/or polyphosphonic acids and/or alkali metal salts thereof are particularly preferred.

Magnesium sulfate and/or magnesium chloride, for example, are used as magnesium salts in the preparations according to the invention.

The preparations according to the invention are produced at temperatures of 15° to 25° C. by successively introducing anionic surfactants, nonionic surfactants, complexing agents and deaerating components into water containing magnesium salts. The resulting aqueous solutions or dispersions of the preparations according to the invention have high dispersion power and high alkali metal and peroxide stability and are low-foaming.

The present invention .also relates to a process for simultaneously desizing, scouring and bleaching cellulose-containing textile materials by application of an aqueous solution containing per liter

| | |
|---|---|
| 5 to 30 ml | of a preparation in the form of an aqueous solution or dispersion containing 5 to 20% by weight alkali metal, alkaline earth metal and/or ammonium salts of $C_{12-18}$ alkane sulfonates and/or $C_{6-18}$ alkyl sulfates, 2 to 10% by weight alkoxylated aliphatic $C_{8-22}$ alcohols, 5 to 20% by weight deaerating components, 1 to 10% by weight complexing agents and 0.1 to 1% by weight magnesium salts, based in each case on the water-containing preparation, |
| 10 to 100 g | sodium hydroxide, |
| 10 to 40 ml | 100% hydrogen peroxide and |
| 10 to 50 ml | of a stabilizer |

in quantities of 100 to 300% by weight, based on the weight of the textile material.

The aqueous solutions for the process according to the invention are prepared by mixing an aqueous alkaline solution containing hydrogen and, for example, soda waterglass (35% by weight) as stabilizer with the preparation according to the invention. The solutions obtained are applied in quantities of 100 to 300% by weight, based on the weight of the textile material, preferably by the aerosol/superheated steam method. The treatment preparation is then left to act on the textile fibers in known manner for 0.5 to 4 minutes and preferably for 0.5 to 3 minutes at 100° C. in a saturated steam atmosphere. The textile material is then washed at 60° to 98° C.

The preparations according to the invention are also suitable for the causticization of cellulose-containing textile materials providing they do not contain any magnesium salts.

Examples of cellulose-containing textile materials are cotton, linen, gray cotton cloth, jute, blends of cotton and polyester and blends of cotton and polyamide. The textile materials may be present in the form of woven fabrics, knitted fabrics and nonwovens.

The cellulose-containing textile materials treated by the process according to the invention are distinguished by high whiteness, have a low average degree of polymerization and good rewettability and are husk-free.

One possibility of modifying the introduction of the water-based treatment liquor(s) during application of the liquor to the web-form textile material is discussed in the following:

The special technology of the metering and application system can be adapted according to the particular stability of a multicomponent mixture to be applied to the web-form textile material. If the multicomponent mixture to be applied in the form of a water-containing liquor shows sufficient stability at the active-substance concentrations to be selected for the particular process, even in cases where the components used are mixed in only one treatment liquor, the mixture of active components may be mixed to form a liquor and may be introduced in this form into the liquid-carrying nozzles of the superheated steam spraying system. If this preliminary mixing of the active components does not appear advisable, for example for reasons of inadequate stability of the water-based multicomponent liquor, the treatment liquor is made available in the process according to the invention by introduction in the form of individual components for example. It can be useful in this regard to mix the individual liquor streams to be combined with one another immediately before they enter the spray nozzle so that the mixed state exists for only a very short time before the liquor impinges on the textile material. The two above-described extreme cases of the introduction of multicomponent mixtures may of course also be combined with one another so that, for example, individual liquor streams at least partly containing partial mixtures of all the active substances to be applied may be envisaged. Considerations as to the optimal choice of the application technology are also determined inter alia by the degree of retention of individual active substances or several active substances in the water-containing liquor, particularly in admixture with the other active components.

Another factor to be taken into consideration in this regard may lie in the choice of the particular character of the textile material to be treated. If the textile material is to be introduced into the process stage of the invention in the form of a dry web, lower concentrations of active substances may be used in the treatment liquor than in the case of wet-in-wet application. In the latter case, the degree of retention of high concentrations of active substances vulnerable to decomposition, for example hydrogen peroxide, can be jeopardized to such an extent that the introduction of individual components is a more suitable alternative.

EXAMPLES

Production of Preparations According to the Invention

Production Example 1

7 g magnesium sulfate are dissolved in 443 ml fully deionized water in a stirred vessel. 300 g 2-ethylhexyl sulfate, sodium salt, in the form of a 34% by weight aqueous solution, 70 g of a low-foaming nonionic surfactant mixture based on $C_{10-14}$ fatty alcohol EO/PO alkoxylates, 60 g of a mixture of aminotri(methylene phosphonic acid), sodium salt, and 1-hydroxyethane diphosphonic acid, sodium salt (30% by weight aqueous solution), and 120 g tributoxyethyl phosphate were then successively added with stirring. The homogeneous mixture obtained, of which the pH value was adjusted to 6.0 with 60% by weight acetic acid, was a clear liquid.

Production Example 2

5 g magnesium sulfate were dissolved in 473 ml fully deionized water in a stirred vessel. 270 g $C_{12/14}$ alkane sulfonate, sodium salt, in the form of an aqueous solution, 62 g of a low-foaming nonionic surfactant mixture based on $C_{10-14}$ fatty alcohol EO/PO alkoxylates, 90 g of a mixture of aminotri(methylene phosphonic acid), sodium salt, and 1-hydroxyethane diphosphonic acid, sodium salt (30% by weight aqueous solution), and 100 g tributoxyethyl phosphate were then successively, added with stirring. The homogeneous mixture obtained, of which the pH value was adjusted to 6.0 with 60% by weight acetic acid, was a clear liquid.

Application Examples

The treated textile materials were subjected to the following tests:

- Whiteness was measured with a Zeiss RFC 18 spectral photometer and evaluated on the Berger scale.
- The average degree of polymerization (DP value) was determined in accordance with DIN 54 270 (Part 3), EWNN process.
- The residual covering was determined in accordance with DIN 54 285.
- To detect polyvinyl alcohol (PV), chromic acid solution was applied to a fabric sample. After a contact time of 1.5 minutes, three drops of a 50% by weight sodium hydroxide were applied. In the absence of polyvinyl alcohol, a yellow to green coloration is observed.
- Absorbency was determined in accordance with DIN 53 924.

Single-Stage Continuous Treatment According to the Invention

An aqueous solution containing per liter 20 ml soda waterglass (35% by weight), 30 g NaOH (100%), 20 ml of a mixture according to the invention corresponding to Production Example 1 and 80 ml 36% by weight hydrogen peroxide was applied under pressure in the form of an aerosol to a gray cloth sized with starch. The liquor uptake amounted to 130% by weight. The gray cloth was then exposed for 2 minutes to a saturated steam atmosphere (100° C.) in a steamer. After washing and drying in known manner, a husk-free undamaged cotton cloth was obtained.

Multistage Continuous Treatment in Accordance with the Prior Art (Comparison Test)

Gray cloth sized with starch was treated in three successive process stages in which the gray cloth was passed through the particular treatment liquor. After excess liquor had been squeezed off, the gray cloth was exposed to a saturated steam atmosphere at 100° C., after which the treatment preparation was removed from the cloth by washing. Each treatment liquor contained a mixture of 25% by weight $C_{13}$ alkane sulfonate (sodium salt), 18% by weight $C_{8-14}$ alkyl alcohol•4.5 mol propylene oxide•5.5 mol ethylene oxide and 57% by weight water as wetting agent.

| | |
|---|---|
| Desizing | 5 g/l liquor enzyme<br>5 g/l liquor wetting agent |
| Liquor uptake: | 85% by weight |
| Reaction time: | 8 minutes saturated steam atmosphere |

-continued

| | |
|---|---|
| Washing | |
| Alkali stage: | 30 g/l liquor NaOH (100%)<br>5 g/l liquor wetting agent<br>2 g/l of a complexing agent mixture (ATMP + HEDP) |
| Liquor uptake: | 95% by weight |
| Reaction time: | 15 minutes saturated steam atmosphere |
| Washing | |
| Bleaching stage | 0.15 g/l liquor magnesium sulfate<br>12 ml/l liquor soda waterglass (35% by weight)<br>5 g/l liquor NaOH (100%)<br>3 g/l liquor wetting agent<br>2 g/l complexing agent mixture (ATMP + HEDP)<br>40 ml/l liquor hydrogen peroxide (35% by weight) |
| Liquor uptake: | 100% by weight |
| Reaction time: | 10 minutes saturated steam atmosphere |
| Washing | |
| Drying | |

The results of the tests carried out on the gray cloths are summarized in the following.

| | Cotton cloth treated in accordance with | |
|---|---|---|
| | the invention | the prior art |
| Whiteness | 71–74 | 70–75 |
| DP value | 2550–2860 | 2600–2900 |
| Residual covering (% by weight) | 0.3–0.6 | 0.2–0.5 |
| Absorbency 1 cm height in seconds | 4–14 | 5–15 |

Single-Stage Continuous Treatment According to the Invention

An aqueous solution containing per liter 20 ml soda waterglass (35% by weight), 30 g NaOH (100%), 20 ml of a preparation according to the invention produced in accordance with Production Example 2 and 80 ml 35% by weight hydrogen peroxide was applied under pressure in the form of an aerosol to a gray cloth of polyester/cotton (65%/35%) sized with starch and polyvinyl alcohol. The liquor uptake amounted to 130% by weight. The textile material was then exposed to a saturated steam atmosphere for 1 minute at 100° C. in a steamer. The polyester/cotton fabric obtained after washing and drying in known manner was free from polyvinyl alcohol although it had not been separately desized.

Two-Stage Continuous Treatment in Accordance with the Prior Art (Comparison Test)

A gray polyester/cotton (65%/35%) cloth sized with starch and polyvinyl alcohol was passed in two successive process stages through a desizing liquor and a bleaching liquor. After the respective liquors had been squeezed off, the cloth was exposed to a saturated steam atmosphere at 100° C. and the treatment preparation was subsequently removed from the cloth by washing. Both treatment liquors contained a mixture of 25% by weight $C_{13}$ alkane sulfonate (sodium salt), 18% by weight $C_{8-14}$ alkyl alcohol•4.5 mol propylene oxide•5.5 mol ethylene oxide and 57% by weight water.

| | |
|---|---|
| Desizing | 5 g/l liquor enzyme<br>5 g/l liquor wetting agent |
| Liquor uptake: | 80% by weight |
| Reaction time: | 8 minutes saturated steam atmosphere |
| Washing | |
| Bleaching Stage | 0.15 g/l magnesium sulfate<br>12 ml/l liquor soda waterglass (35% by weight)<br>8 g/l liquor NaOH (100%)<br>7 g/l liquor wetting agent<br>2 g/l complexing agent mixture (ATMP + HETP)<br>30 ml/l liquor 35% by weight hydrogen peroxide |
| Liquor uptake: | 90% by weight |
| Reaction time: | 12 minutes saturated steam atmosphere |
| Washing | |
| Drying | |

The results of the tests carried out on the treated polyester/cotton cloths are summarized in the following:

| | Polyester/cotton treated in accordance with | |
|---|---|---|
| | the invention | the prior art |
| Whiteness | 98–118 | 100–112 |
| Residual covering (% by weight) | 0.2–0.5 | 0.1–0.5 |
| PVA test | 0 | 0 |
| Absorbency 1 cm height in seconds | 3–14 | 4–16 |

We claim:

1. A process for the aerosol/superheated steam application of water-based treatment liquors by spraying in the continuous treatment of web-form textile materials, wherein said water-based treatment liquors consist essentially of water, an anionic surfactant, a nonionic surfactant, sodium hydroxide, hydrogen peroxide, and a deaerating agent consisting of phosphoric acid triesters of lower, at least partly alkoxylated alkyl alcohols which is either dissolved, homogeneously emulsified or homogeneously dispersed in said water-based treatment liquors in a quantity of at least 0.01 to 0.02% by weight.

2. The process as in claim 1 wherein said treatment liquor is applied under high spraying pressures using multicomponent mixing nozzles with external mixing of sprayed water-based liquor and superheated steam.

3. The process as in claim 1 wherein said alkoxylated alkyl alcohols comprise linear, branched or cyclic $C_{1-6}$ alkyl alcohols having a degree of alkoxylation of 1 to 5.

4. The process as in claim 1 wherein said water-based treatment liquors contain up to about 1% by weight of said deaerating agent.

5. The process as in claim 1 wherein said web-form textile materials are present in dry or wet form, the water content of wet form material being below 100% by weight, based on the dry weight of the textile material.

6. The process as in claim 1 wherein the total quantity of liquid phase introduced is limited so that the liquor uptake capacity of said textile material is not exceeded.

7. The process as in claim 1 wherein said treatment stage is conducted for a period of up to about 5 minutes.

8. The process as in claim 1 wherein said water-based treatment liquors contain the additives required for the intended textile treatment in dissolved, emulsified and dispersed form.

9. The process as in claim 1 wherein said treatment liquors contain mixtures of active substances for the simultaneous completion of a plurality of textile finishing stages.

10. A process for the aerosol/superheated steam application of water-based treatment liquors by spraying in the continuous treatment of web-form cellulose-containing textile material with a water-based liquor containing per liter 5 to 30 ml of a preparation in the form of an aqueous solution or dispersion containing 5 to 20% by weight anionic surfactant, 2 to 10% by weight nonionic surfactant, 5 to 20% by weight of dearating agents comprising phosphoric acid triesters of lower, at least partly alkoxylated alkyl alcohols, 1 to 10% by weight chelating agents and 0.1 to 1% by weight magnesium salts, based in each case on the water-containing preparation, 10 to 100 g sodium hydroxide, 10 to 40 ml hydrogen peroxide (100%), and 10 to 50 ml of a stabilizer in a quantity of 100 to 300% by weight, based on the weight of the textile material, for simultaneous desizing, scouring and bleaching.

11. The process as in claim 10 wherein said water-based liquor contains 5 to 30 ml of a preparation in the form of an aqueous solution or dispersion containing 5 to 12% by weight anionic surfactant, 2 to 8% by weight nonionic surfactant, 6 to 12% by weight of said deaerating agents, 1 to 5% by weight chelating agents and 0.2 to 0.8% by weight magnesium salts, based in each case on said water-based liquor.

12. The process as in claim 10 wherein said liquor contains alkali metal or ammonium salts of $C_{8-18}$ alkyl sulfates and alkoxylated aliphatic $C_{10-18}$ alcohols having degrees of alkoxylation of 1 to 20.

13. The process as in claim 10 wherein said liquor contains nitrogen-containing or nitrogen-free mono-, di- or polyphosphonic acids or alkali metal or ammonium salts thereof or OH-functional mono-, di or polycarboxylic acids or alkali metal or ammonium salts thereof as chelating agents.

14. A composition in the form of an aqueous solution or dispersion containing 5 to 20% by weight anionic surfactant, 2 to 10% by weight nonionic surfactant, 5 to 20% by weight phosphoric acid triesters of lower, at least partly alkoxylated alkyl alcohols, 1 to 10% by weight chelating agents, and 0.1 to 1% by weight magnesium salts.

15. A composition in claim 14 wherein said composition contains 5 to 12% by weight anionic surfactant, 2 to 8% by weight nonionic surfactant, 6 to 12% by weight phosphoric acid triesters of lower, at least partly alkoxylated alkyl alcohols, 1 to 5% by weight chelating agents, and 0.2 to 0.8% by weight magnesium salts.

16. A composition as in claim 14 containing alkali metal or ammonium salts of $C_{8-18}$ alkyl sulfates and alkoxylated aliphatic $C_{10-18}$ alcohols having degrees of alkoxylation of 1 to 20.

17. A composition as in claim 14 containing phosphoric acid triesters of alkoxylated $C_{1-6}$ alkyl alcohols.

18. A composition as in claim 14 wherein said chelating agents are selected from the group consisting of nitrogen-containing or nitrogen-free mono-, di- or polyphosphonic acids or alkali metal or ammonium salts thereof, and OH-functional mono-, di- or polycarboxylic acids or alkali metal or ammonium salts thereof.

* * * * *